US005924176A

United States Patent [19]

Lee

[11] Patent Number: 5,924,176

[45] Date of Patent: Jul. 20, 1999

[54] INTEGRALLY MOLDED CLASP STRUCTURE

[76] Inventor: Hung Wen Lee, No. 447, Sec. 2, Tung Ta Road, Hsinchu, Taiwan

[21] Appl. No.: 09/071,350

[22] Filed: May 1, 1998

Related U.S. Application Data

[51] Int. Cl.[6] ..... A44B 21/00

[52] U.S. Cl. ..... 24/553; 24/552

[58] Field of Search ..... 24/551, 552, 553, 24/554, 545, 546, 557, DIG. 29, 327

[56] References Cited

U.S. PATENT DOCUMENTS

| | | | |
|---|---|---|---|
| 4,556,060 | 12/1985 | Perlin | 24/552 X |
| 4,765,355 | 8/1988 | Schmidt et al. | 24/552 X |
| 4,796,625 | 1/1989 | Kees, Jr. | 24/552 X |
| 5,159,731 | 11/1992 | Dereadt | 24/552 |
| 5,217,464 | 6/1993 | McDonald | 24/552 X |
| 5,535,970 | 7/1996 | Gobbi | 24/557 X |
| 5,687,458 | 11/1997 | Coker | 24/553 X |

*Primary Examiner*—James R. Brittain
*Assistant Examiner*—Robert J. Sandy
*Attorney, Agent, or Firm*—Rosenberg, Klein & Bilker

[57] ABSTRACT

A clasp structure that is integrally molded is provided and comprises an actuating lever portion, an upper clasping portion, and a lower clasping portion. The actuating lever portion is arcuate in shape and divided at an apex into an upper actuating portion and a lower actuating portion. The upper actuating portion is provided on its internal wall surface with a lower clasping portion. The lower actuating portion also joins with an upper clasping portion on the internal wall surface. The upper clasping portion attaches at one end to the lower clasping portion and extends obliquely at the other end for a certain length and then forms a horizontal clasping surface. Likewise, the lower clasping portion connects at one end to the upper actuating portion of the actuating lever portion and extends inclinedly downward at the other end for a proper length and then forms a horizontal clasping surface that rests on the horizontal clasping surface of the upper clasping portion.

1 Claim, 3 Drawing Sheets

INTEGRALLY MOLDED CLASP STRUCTURE

BACKGROUND OF THE INVENTION

The clasp described here is a small stretchable tool used to hold or grip things firmly, like clothespins that people use to fasten clothes or clothes line. However, along with the above functions, the clasp of the invention also can be used as a fixture to hold Christmas light bulb series and ornaments. A prior art configuration for such a clasp is shown in FIGS. 1 and 2, which is composed of an upper clamping part (1), a lower clamping part (2), and a spring (3). The upper and the lower clamping parts are respectively a separate body. When the upper and the lower parts (1, 2) are put together, the spring (3) seated between them, with one end abutting against the top surface of the upper clamping part (1) and the other end pressing against the bottom surface of the lower clamping part (2), gives the clasp a holding capability. Users press against rear ends of the upper and the lower clamping parts (1, 2) to make their front ends separate from each other to receive objects to be gripped. This prior art configuration needs more assembling work, which in turn increases manufacturing costs. Furthermore, such connection also makes the assembly easy-to-separate when users improperly apply forces to the clasp, producing inconvenience in use.

The primary object of the present invention is to provide a clasp structure consisting of an actuating lever portion, an upper and a lower clasping portion that can be integrally molded without further assembling requirements. Thus the invention can reduce production costs, eliminate the possibility of falling into pieces due to unforeseen incidents, and provide convenience in use.

The structural features, advantages, and functions of the present invention will become clear when consideration is given to the following detailed description of preferred embodiments with reference to the accompanying drawings.

BRIEF DESCRIPTION OF ACCOMPANYING DRAWINGS

DETAILED DESCRIPTION OF PREFERRED EMBODIMENTS

Figure 1:
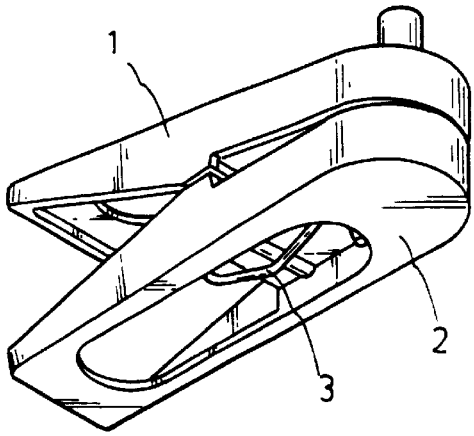
FIG. 1 (prior art)
FIG. 1 is a perspective view showing the outer appearance of a prior art clasp.
Figure 2:
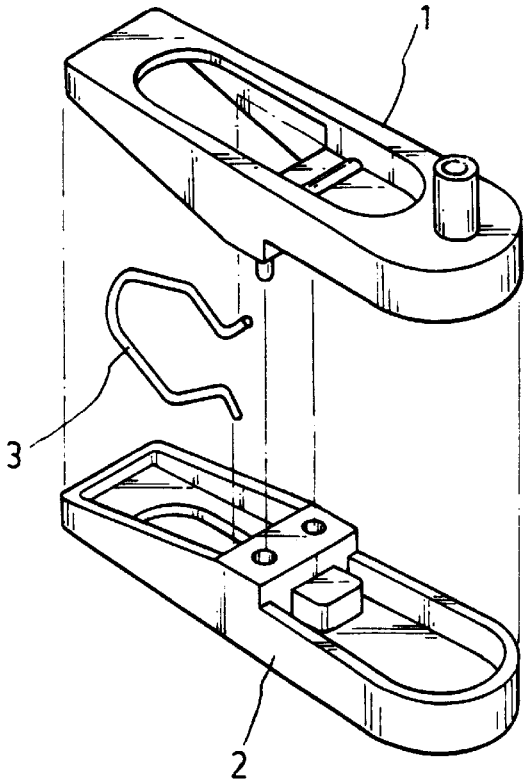
FIG. 2 (prior art)
FIG. 2 is an exploded view of the clasp of FIG. 1.
Figure 3:
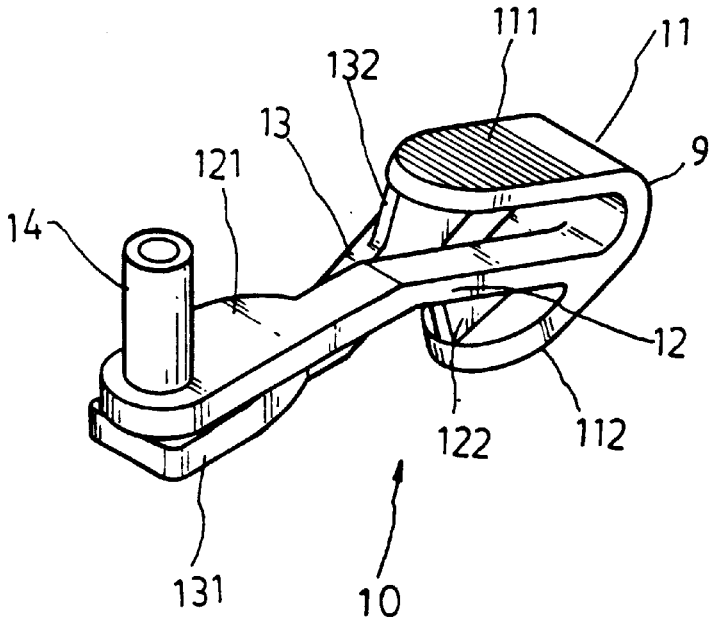
FIG. 3 is a perspective view showing the outer appearance of a clasp structure according to the invention.
Figure 4:
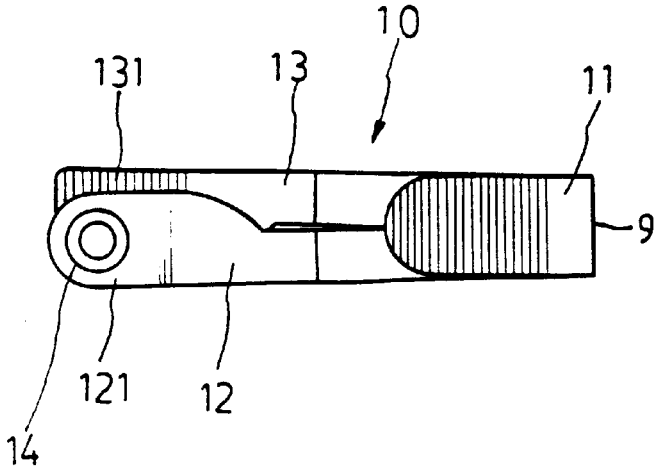
FIG. 4 is a top view of the clasp structure of FIG. 3.
Figure 5:
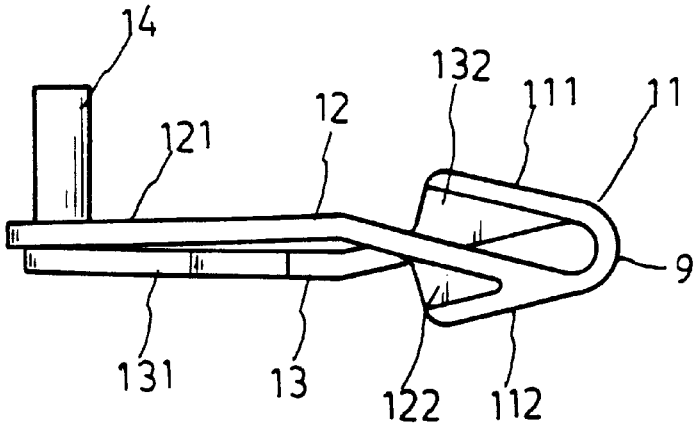
FIG. 5 is a side view of the clasp structure of FIG. 3.
Figure 6:
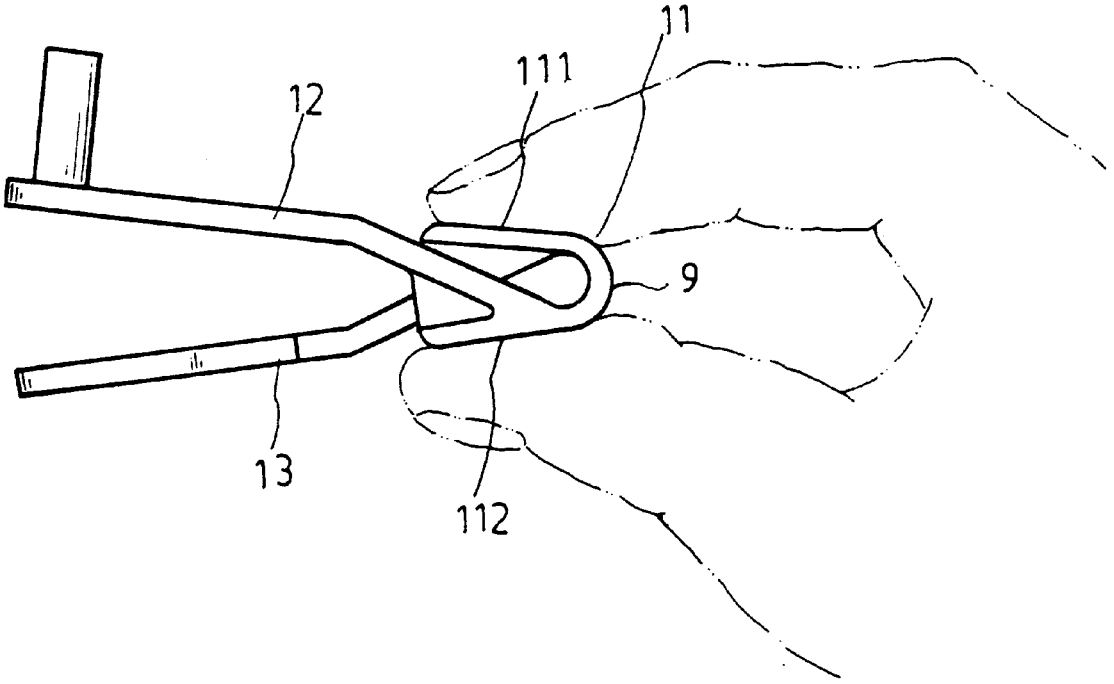
FIG. 6 shows a practical example of the clasp structure of the invention.

Referring to FIGS. 3 through 6, the clasp structure (10) according to the invention has an integrally molded body consisting of an actuating lever portion (11), an upper clasping portion (12) and a lower clasping portion (13). The actuating lever portion (11) is arcuate in configuration, and divided at an apex 9 into an upper actuating portion (111) and a lower actuating portion (112). The upper clasping portion (12) joins the lower actuating portion (112) on the internal wall surface of the lower actuating portion (112) near the apex 9 and obliquely extends upwards. The width of the upper clasping portion (12) is preferably not larger than half of the surface width of the actuating lever portion (11). The upper clasping portion (12) has at its free end a horizontal clasping surface (121) that extends inwards to such an extent that it has a width approximately equal to the surface width of the actuating lever portion (11). A rib (122) is disposed on the bottom surface of the upper clasping portion (12) and extends to the top surface of the lower actuating portion (112). Further, the top surface of the upper clasping portion (12) integrates with a hollow upright engagement pole (14). The lower clasping portion (13) is associated with the internal wall surface of the upper actuating portion (111) at a position near the apex 9 of the actuating lever portion (11) and inclinedly extends downward and outwards in a symmetrical relation to the upper clasping portion (12), with a body width less than half of the width of the actuating lever portion (11). The lower clasping portion (13) also has a horizontal clasping surface (131) at its free end corresponding to the clasping surface (121) of the upper clasping portion (12). Like the upper clasping portion (12), the lower clasping portion (13) also has a rib (132) formed on the top surface thereof and extending to the bottom surface of the bottom surface of the upper actuating portion (111) . The clasping surface (131) extends corresponding to the clasping surface (121) of the upper clasping portion (12) to an extent that the width of the clasping surface (131) approximately equals to the surface width of the actuating lever portion (11). When the clasp is in an inactive state, the top surface (131) of the lower clasping portion keeps in touch with the bottom surface (121) of the upper clasping portion (12) as shown in FIG. 5. With such a configuration, users can apply forces to the upper and the lower actuating portions of the actuating lever portion (11) to urge the upper and the lower clasping portions to separate from each other. When users press the actuating lever portion (11), The upper actuating portion (111) brings the lower clasping portion (13) to move downwards and the lower actuating portion (112) forces the upper clasping portion (12) to move upwards so that the upper and the lower clasping portions (12, 13) constitute an open mouth. In the meantime, the deformation of the actuating lever portion (11) will cause a restoring force that gives the upper and the lower clasping surfaces a gripping force to hold an object seated therebetween.

From the above description, the clasp structure according to the invention has the advantages of compact design and simplified construction that can be integrally molded in one molding shot and has an excellent clasping effect. Hence, it can be manufactured through a simple production process as well as unsophisticated fixtures. As a consequence, the invention can significantly reduce production costs and provide the convenience in use. Evidently it meets the requirements of granting patents. We hereby apply a patent award.

What is claimed is:

1. An integrally molded clasp structure, comprising:

an actuating lever portion having an arcuate contour, said actuating lever portion having an upper actuating portion and a lower actuating portion divided by an apex;

an upper clasping portion extending a predetermined distance from an inner wall surface of said lower actuating portion and spaced from said apex, said upper clasping portion having a distal end formed with a first horizontal clasping surface;

a first rib joining an extended portion of a proximal end of said upper clasping portion to said inner wall surface of said lower actuating portion;

a lower clasping portion extending a predetermined distance from an inner wall surface of said upper actuating portion and spaced from said apex, said lower clasping portion having a distal end formed with a second horizontal clasping surface located in aligned relationship with said first horizontal clasping surface and in contact therewith; and, a second rib joining an extended portion of a proximal end of said lower clasping portion to said inner wall surface of said upper actuating portion, wherein said first horizontal portion is reversibly displaced from said second horizontal portion responsive to a deformation of said actuating lever between said upper clasping portion and said lower clasping portion when said upper actuating portion and said lower actuating portion is depressed.

* * * * *